US007220139B1

(12) United States Patent
Chang et al.

(10) Patent No.: US 7,220,139 B1
(45) Date of Patent: May 22, 2007

(54) UNIVERSAL POWER ADAPTER

(75) Inventors: Hsi-Fan Chang, 8F-6, No. 18, Lane 609, Sec., 5, Chung Shin Road, Sanchung, Taipei (TW); Sheng-Rong Gao, Dongguan (CN)

(73) Assignee: Hsi-Fan Chang, Taipei (TW)

( * ) Notice: Subject to any disclaimer, the term of this patent is extended or adjusted under 35 U.S.C. 154(b) by 0 days.

(21) Appl. No.: 11/428,563

(22) Filed: Jul. 4, 2006

(51) Int. Cl.
*H01R 29/00* (2006.01)

(52) U.S. Cl. ..... 439/172

(58) Field of Classification Search ..... 439/118, 439/172, 166, 173, 109, 106; 200/51.09, 200/51.01

See application file for complete search history.

(56) References Cited

U.S. PATENT DOCUMENTS 3,322,927 A * 5/1967 Waldorf et al. ..... 200/5 B
3,392,598 A * 7/1968 Waldorf et al. ..... 74/483 PB
4,772,215 A * 9/1988 Falk ..... 439/188
4,820,176 A * 4/1989 Niikura ..... 439/152
5,118,301 A * 6/1992 Bentivolio ..... 439/188
5,159,545 A * 10/1992 Lee ..... 363/146
5,306,157 A * 4/1994 Francisco ..... 439/52
5,417,594 A * 5/1995 Herman et al. ..... 439/690
5,480,313 A * 1/1996 d'Alayer de Costemore d'Arc ..... 439/159
6,079,995 A * 6/2000 Duhe, Jr. ..... 439/188
6,328,581 B1 * 12/2001 Lee et al. ..... 439/106
6,495,775 B2 * 12/2002 Lawson et al. ..... 200/50.28

* cited by examiner

*Primary Examiner*—Neil Abrams
*Assistant Examiner*—Phuongchi Nguyen
(74) *Attorney, Agent, or Firm*—Banger Shia

(57) ABSTRACT

A universal power adapter to allow only the plug desired to stick out smoothly in a simple construction and allowing convenient operation is comprised of a lid, a base, a rotary switch, and multiple plugs; multiple channels being disposed on the external wall of the base, a standardized plug being inserted to each channel; a rotary switch containing a bar sliding block and a braking pushbutton; the bar sliding block containing a bar slide and a gap; the pushbutton being inserted into the gap; a protruding block and a slot below being disposed to the top of the plug; the slot receiving the insertion end of the braking pushbutton; and the pushbutton sliding in the channel on the external wall of the base; and the protruding block of each plug being inserted into the bar slide of the bar sliding block to slide against the protruding block.

5 Claims, 9 Drawing Sheets

UNIVERSAL POWER ADAPTER

BACKGROUND OF THE INVENTION (a) Field of the Invention

The present invention is related to a universal power adapter working with variable power socket specifications by nation, and more particularly, to a built-in adapter that allows only one pair of blades sticking out to insert into a socket for achieving electric conduction.

(b) Description of the Prior Art

More people travel around the world for pleasure or business thanks to the ever development of socio-economy, and they usually carry themselves some communication equipment or electric appliance on the road including notebook, handset, MP3, and other electronic products. Whereas all those electronic products relate to power consumption items, a matching adapter must be brought along for recharging purpose. However, different standards of communication interface are adopted in the world. For example, sockets in USA, UK, Europe, and Australia are not of same specifications. Therefore, the electronic product is usually not functioning when prevented form being recharged in a strange country. To solve this problem, one before the trip must find out the specification of the particular plug in the country of destination and purchase an adapter to match the plug. Preparation of the adapter becomes even more inconvenient when one's itinerary involves multiple stops in different countries and too many adapters must be brought before hitting the road.

To cope with the needs of people traveling around the world, a multi-purpose adapter is generally available in the market. The multi-purpose adapter is essentially related to a combination of adapters in specifications of multiple nations. However, when one particular set of plug is selected and inserted into a socket depending on the country the user stays, the user is exposed to risk of electric shock or shortage since the remaining sets of plug are also exposed and protruding from the adapter. Improvements are made to the multi-purpose adapter as taught in Taiwan Patent Publication No. TW541768 and China Patent Publication No. CN1539187A.

According to a multi-purpose adapter socket disclosed in the patent application of TW541768, a security device and a corresponding safety cover are disposed at where the operation takes place on the inner side of the socket in relation to the blades of the power; and a control rod and a locking block linked to a pushbutton indicates a status of lateral displacement to force each power blade locked in place while permitting only one set of power blade to be freed to extend for conduction. Accordingly, the adapter socket is provided with mandatory protection results to improve safe use. However, as the design of a product is smaller, thinner, and lighter oriented, the limited space available in the adapter socket is not in favor of accommodating those additional security device and safety cover. Furthermore, the operation of the adapter socket is compromised by its complicate structure since it is not uncommon when the pushbutton fails or gets stuck.

Another power plug disclosed in China Patent Application No. CN1539187A teaches a casing and multiple standardized plug contacts that movably supported in the casing. Each plug contact is disposed with two conduction blades and both blades are capable of moving out to get into a working location along a slide travel or into an idle location. The plug is characterized by that at least one braking member is mobile in relation to the casing and the terminal of the plug and the braking member is secured to a location externally to the idle location by means of a plug contact. When secured in place, the braking member is disposed at the slide travel designated for any of the remaining plug contacts to prevent another plug contact moving form the idled location into the working location. The option of the prior art as disclosed takes advantage of the braking member disposed in the slide travel to restrict the displacement by any other plug contact; however, the braking member as made in a mobile construction is vulnerable to get loosened up and/or shaking to result in either failure or getting stuck in operation. The prior art disclosed in China Patent Application No. CN1539187A further incorporates a security member in realizing the function of restricting the displacement by any other plug contact. Whereas the strict use of the security member to reach the purpose of restriction fails to bring smooth displacement of the plug, incorporation of a pushbutton is needed to facilitate displacement of the plug. Accordingly, the operation becomes awkward because that the user has to press the pushbutton with one hand and push out the plug with another hand to extend the plug. The operation tends to fail after frequent use of the plug.

SUMMARY OF THE INVENTION

The primary purpose of the present invention is to provide a universal power adapter with built-in multiple plugs in simple construction, allowing easy operation, and well-facilitated pulling out the set of plug desired to correct the defectives found with the prior art by selecting only the right set of plug to stick out of the adapter socket for recharging an electronic product depending on the local power specifications.

To achieve the purpose, the present invention is essentially comprised of a lid and a base; multiple channels are disposed on the outer wall of the base; a standardized plug is inserted in the base at where in relation to each channel; a rotary switch includes a bar sliding block disposed with a bar slide and a gap, and a braking pushbutton inserted in the gap; a protruding block is disposed to the upper end of each plug and a slot is disposed merely below the protruding block to accommodate an insertion end of the braking pushbutton; the insertion end slides in the channel disposed along the external wall of the base; the protruding block from each plug is inserted into the bar slide of the bar sliding block; the bar sliding block passes the bar slide to slide along each protruding block; the bar sliding block is made in an arc construction; an accommodation space containing a spring is disposed to the insertion end of the braking pushbutton; the braking pushbutton pushes out a plug along the channel; and the braking pushbutton is ejected by the spring to be secured in place by engaging the channel. Each plug is disposed with a metal plate to contact a connection conductor, and a pair of blades in relation to a power socket. The lid is disposed with a pair of adapter outlets, and a metal contact conducted to the connection conductor is inserted in each outlet. The base is provided with through holes for the selected plug to stick out.

When compared to the prior art, the preset invention provides the following advantages:

1. Depending on the power specifications of the nation, the adapter socket permits only the plug complying with the power specifications to be pulled out for conduction; and 2. The present invention is simple in construction and allows easy operation with the design of the rotary switch to facilitate pulling out the plug desired.

BRIEF DESCRIPTION OF THE DRAWINGS

FIG. 10 (B) is a magnified view of the appearance of a plug of Australian specification built in the present invention.

FIG. 10 (C) is a magnified view of the appearance of a plug of UK specification built in the present invention.

FIG. 10 (D) is a magnified view of the appearance of a plug of USA specification built in the present invention.

DETAILED DESCRIPTION OF THE PREFERRED EMBODIMENTS

It is to be noted that the preferred embodiment of the present invention includes but not limited to four types of standardized plug respectively from Europe, Australia, UK, and USA.

Figure 1:
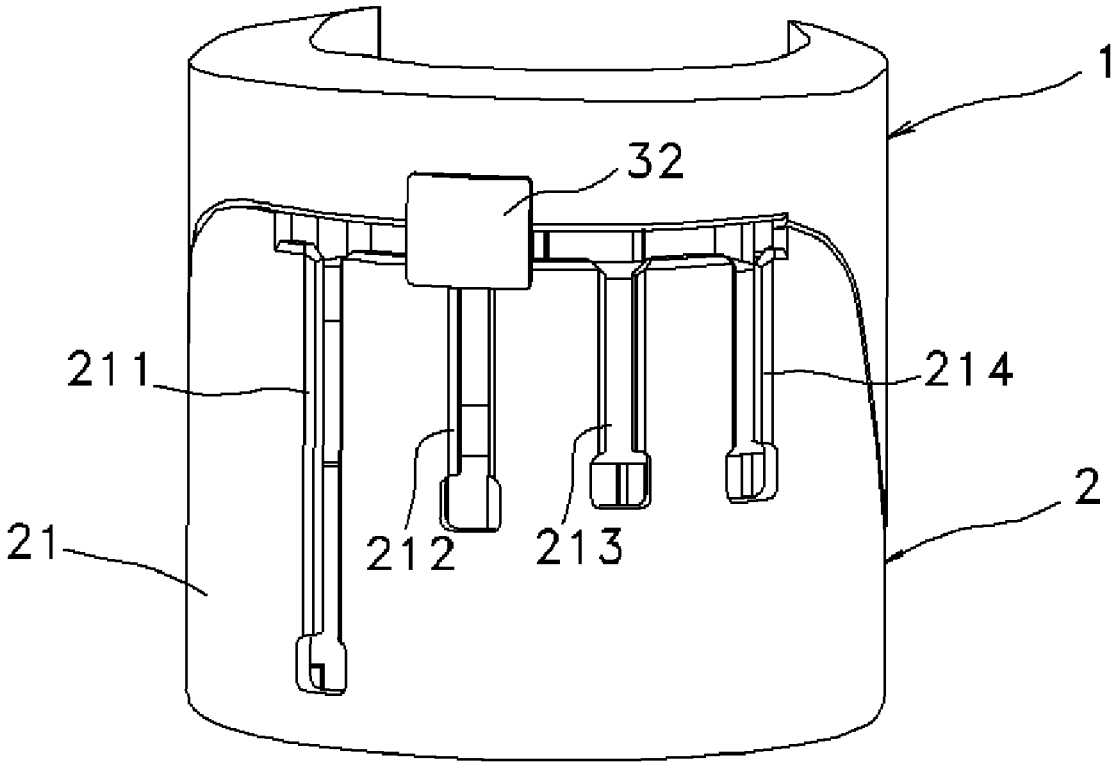
FIG. 1 is a schematic view of the appearance of the present invention.
Figure 2:
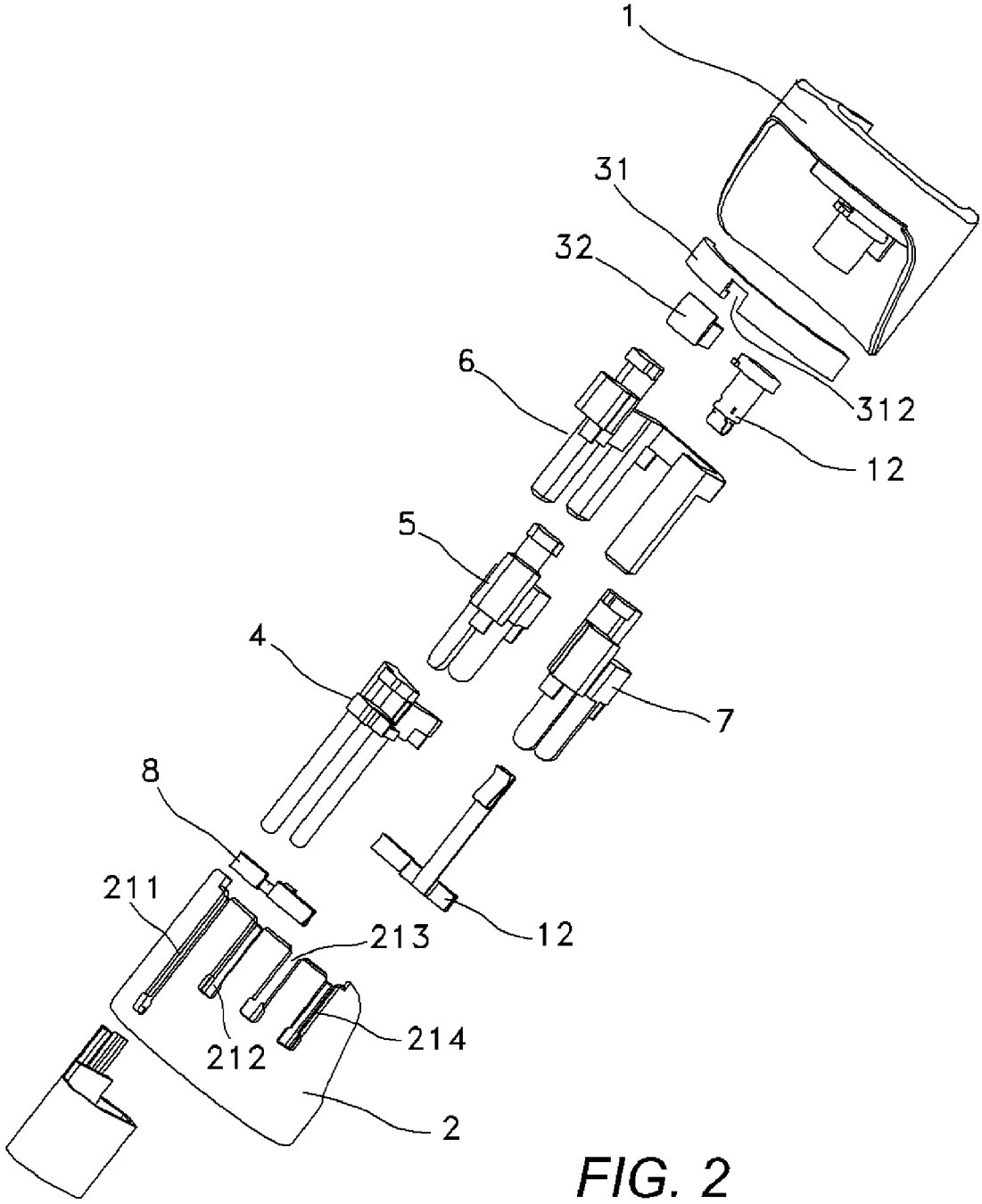
FIG. 2 is an exploded view of the present invention.

Referring to FIGS. 1 and 2, a universal power adapter includes a lid 1, a base 2, a rotary switch 3, a European plug 4, an Australian plug 5, a UK plug 6, and a USA plug 7, and a connection conductor 8.

Figure 3:
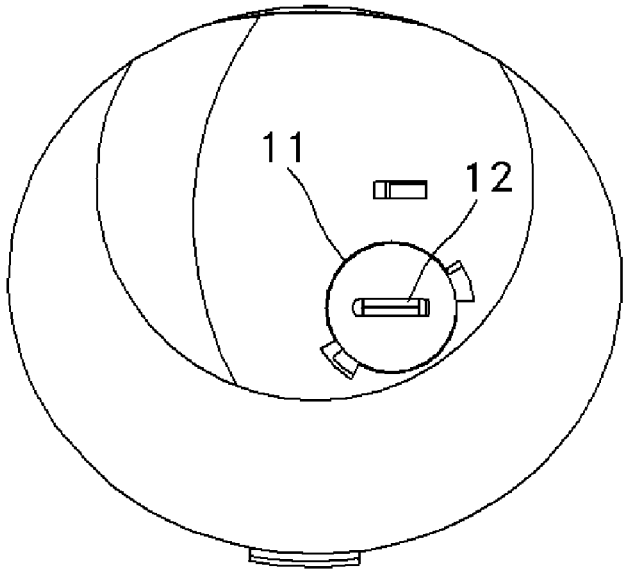
FIG. 3 is a bird's view of the present invention.

Also referring to FIG. 3, the top of the lid 1 is recessed and contains multiple outlets 11 indifferent forms; and a metal contact plate 12 is inserted through the outlet 11 for external connection to a corresponding adapter cable. The construction of the top of the lid relates to the prior art and will not be elaborated herein.

Figure 4:
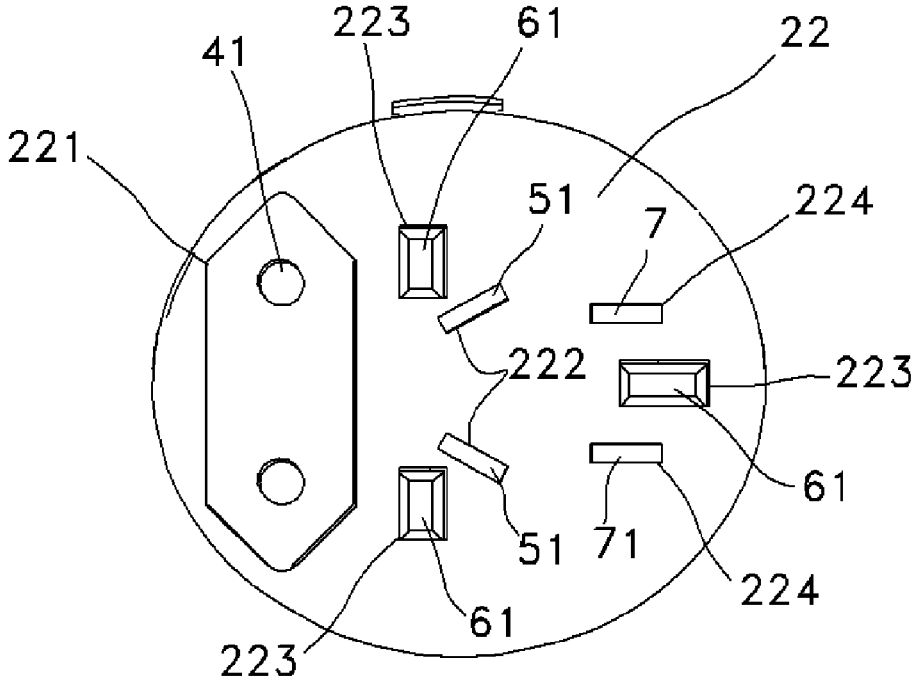
FIG. 4 is an upward view of the present invention.
Figure 5:
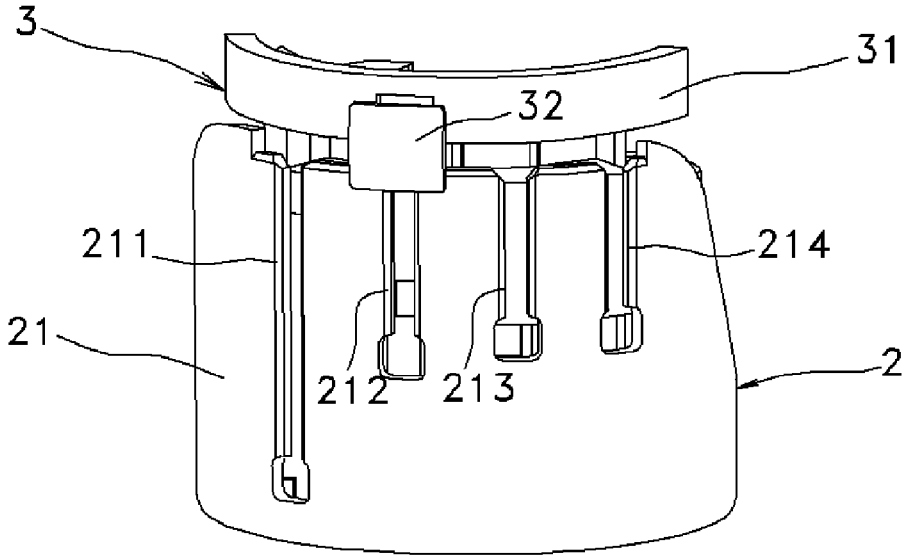
FIG. 5 is a schematic view of the present invention as illustrated in FIG. 1 with a lid removed.
Figure 6:
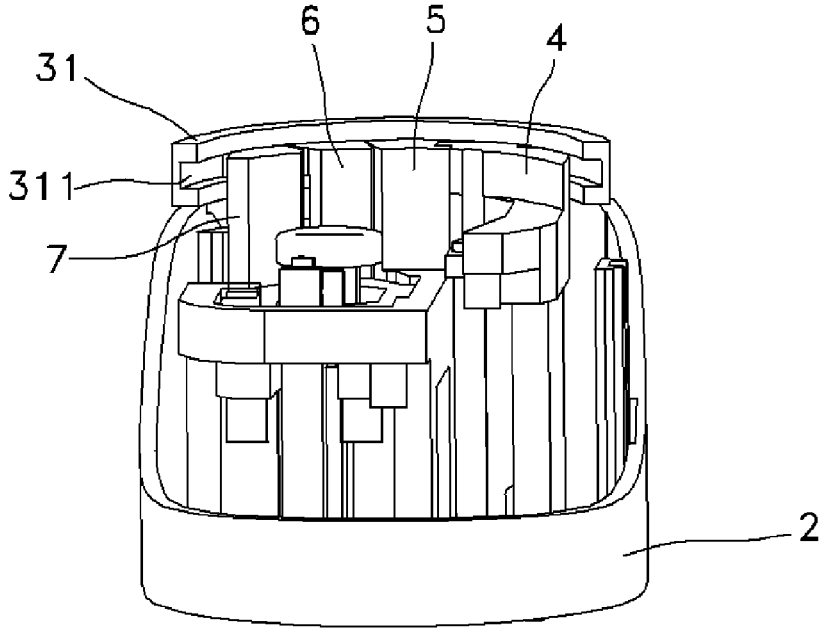
FIG. 6 is a schematic view showing the appearance at a different angle from that as illustrated in FIG. 5.
Figure 7:
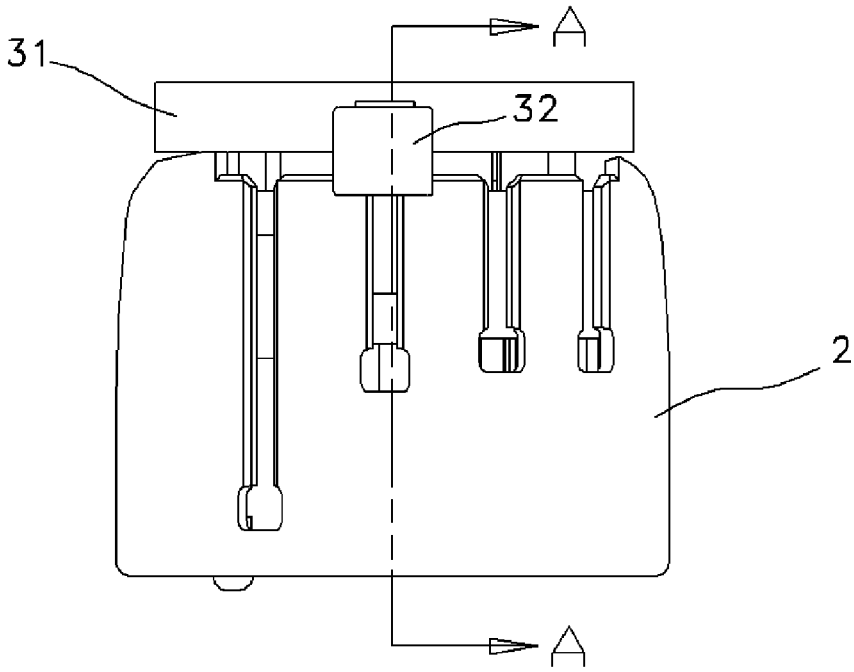
FIG. 7 is a front view of the present invention as illustrated in FIG. 5.
Figure 8:
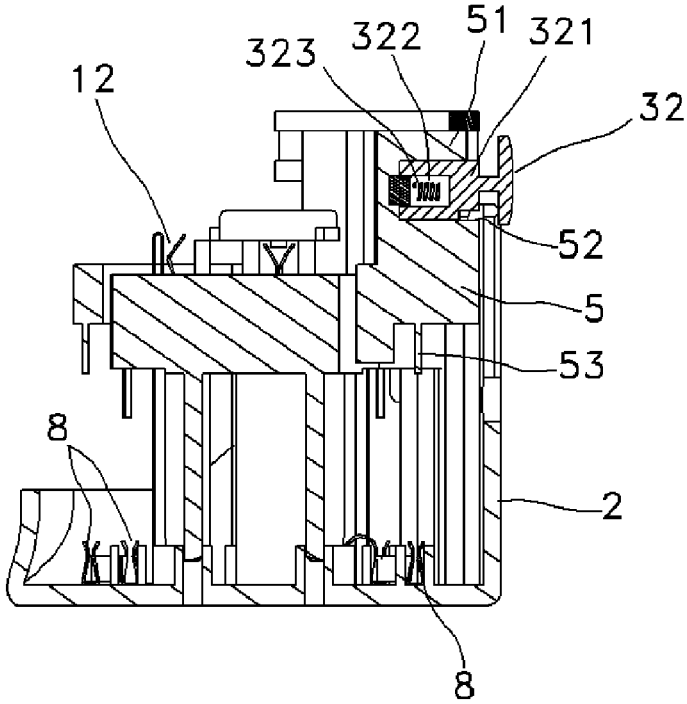
FIG. 8 is a sectional view taken from A—A in FIG. 7.
Figure 9:
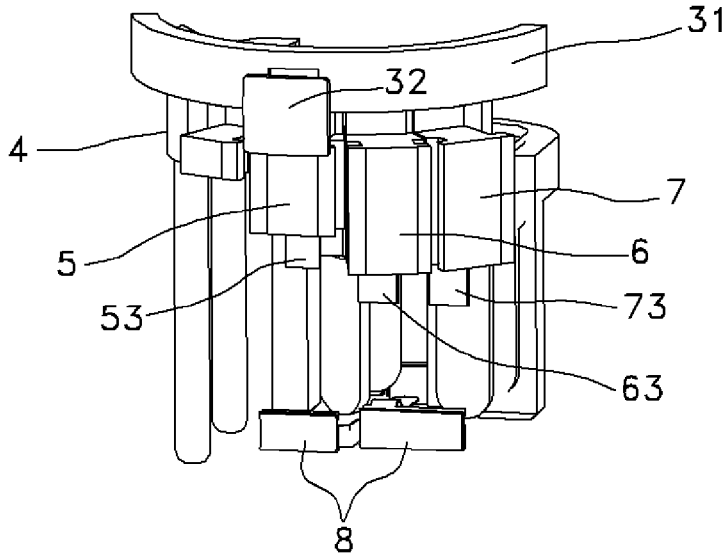
FIG. 9 is a schematic view of the present invention as illustrated in FIG. 5 with a base removed.
Figure 10A:
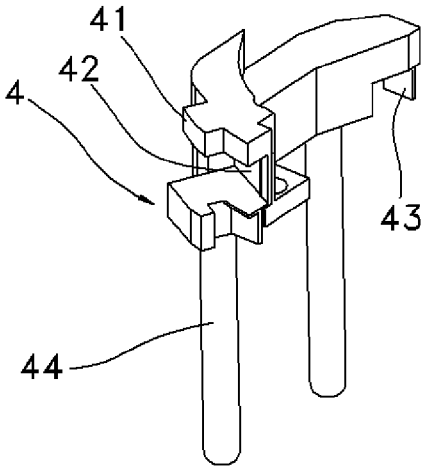
FIG. 10 (A) is a magnified view of the appearance of a plug of European specification built in the present invention.
Figure 10B:
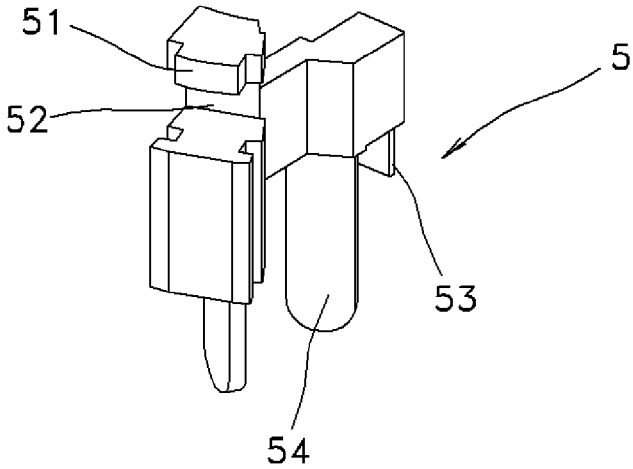
Figure 10C:
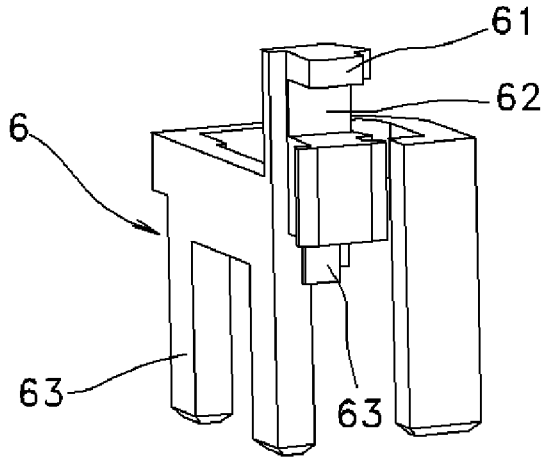
Figure 10D:
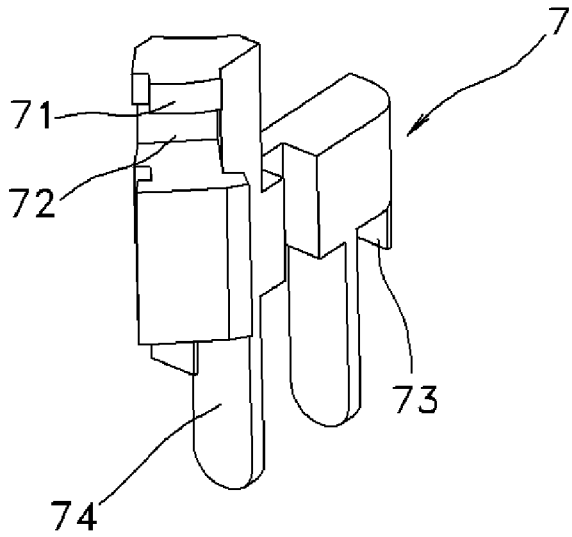

Four channels 211, 212, 213, 214 are disposed on an external wall 21 of the base 2; and on a bottom of the base 2, multiple pairs of through holes 221, 222, 223, 224 corresponding in sequence to the layout of the shape of blades respectively of European plug 4, the Australian plug 5, the UK plug 6, and the USA plug 7 as illustrated in FIG. 4. The construction of those multiple holes for the pair of blades of each plug is also related to the prior art and will not be elaborated herein.

Now referring to FIGS. 5 through 9, the rotary switch 3 includes a bar sliding block 31 and a braking pushbutton 32. The bar sliding block 31 indicating an arc structure is disposed with a bar slide 311 and a gap 312; the braking pushbutton 32 is inserted into the gap 312; an insertion end 321 of the braking pushbutton 32 contains a space 322; and a spring 323 is installed in the space 321 to facilitate controlling the braking pushbutton 32.

FIGS. 10 (A), 10 (B), 10 (C), and 10 (D) respectively shows the appearance of the European plug 4, the Australian plug 5, the UK plug 6, and the USA plug. A protruding block 41 is disposed to the top of the European plug 4 and a slot 42 is disposed merely below the protruding block 41. The slot 42 receives the insertion end of the braking pushbutton 32 and the protruding block 41 is inserted into the bar slide 311 of the bar sliding block 31 from the rotary switch 3 with the bar slide 311 sliding against the protruding block 41. A metal plate 43 to provide electric contact with a connection conductor 8 is disposed on the distal end to the protruding block 41, and a pair of blades 44 is disposed to the plug 4. The structure of top of the Australian plug 5 is similar to that of the European plug 4; wherein, a protruding block 51, a slot 52, a metal plate 53, and a pair of blades 54 are also provided. The construction of either of the UK plug 6 or the USA plug 7 is also similar to that of either the European plug 4 or the Australian plug 5; wherein, protruding blocks 61, 71, slots 62, 72, metal plates 63, 73, and blades 64, 74 are respectively disposed. The protruding block 51, 61 or 71 is inserted into the bar slide 311 of the bar sliding block 31 from the rotary switch 3 and the bar slide 311 is capable of sliding against each protruding block. The metal plate 53, 63, or 73 produces electric conduction by electrically contacting the connection conductor 8.

The working principle of the present invention involves having the bar sliding block in the rotary switch to slide against the protruding block of each plug as guided by the bar slide; and the braking pushbutton inserted into the gap of the bar sliding block is also turned accordingly until the insertion end of the braking pushbutton slides into the slot of the plug selected. In turn, the protruding block of the pushbutton is secured in the gap without being subject to the function of the bar slide while the remaining plus are secured as interfered by the bar slide since their respective protruding blocks are inserted in the bar slides so to warrant that only one set of plug is allowed to extend for conduction by insertion. Therefore, once the plug is selected, the pushbutton is pushed down along the channel of the base to its lowest end, the force of the spring contained in the pushbutton ejects the pushbutton for the pushbutton to engage the wall of the channel and thus to be secured in place. Meanwhile, both blades of the plug selected stick out of their respective through holes in the base to contact the connection conductor by means of the metal plate disposed to the plug. Finally, the electric conduction for the electronic appliance is completed in easy and convenient fashion. Upon completing the recharging, the pushbutton is pushed up; and the operation described above is repeated when any other plug is selected for subsequent use.

Figure 11:
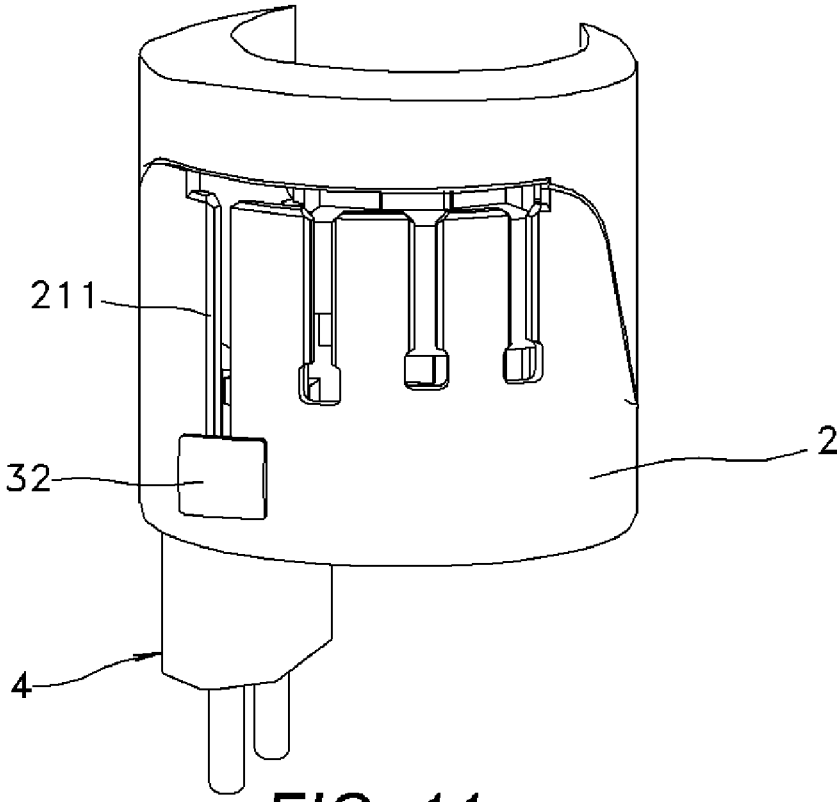
FIG. 11 is a schematic view showing an operating status of the present invention with a plug of European specification sticking out.
Figure 12:
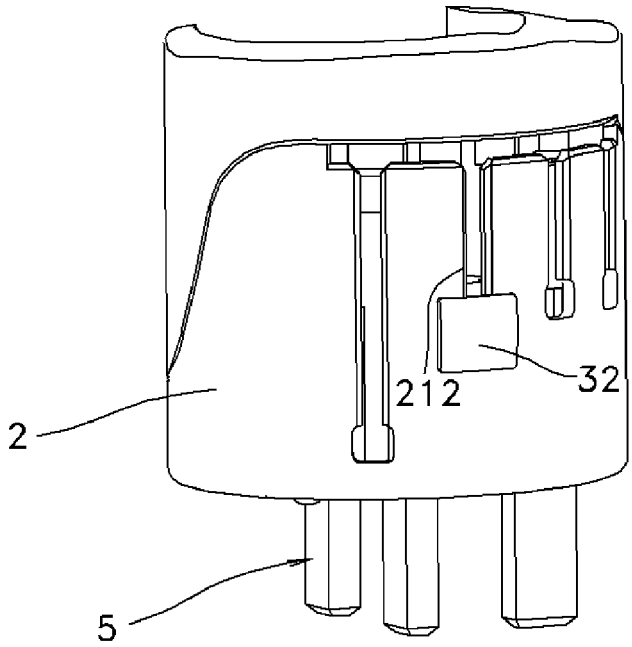
FIG. 12 is a schematic view showing an operating status of the present invention with a plug of Australian specification sticking out.
Figure 13:
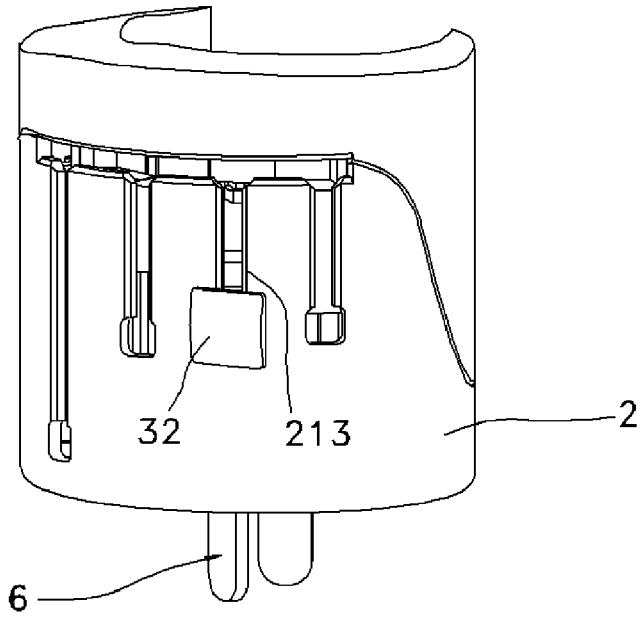
FIG. 13 is a schematic view showing an operating status of the present invention with a plug of UK specification sticking out.
Figure 14:
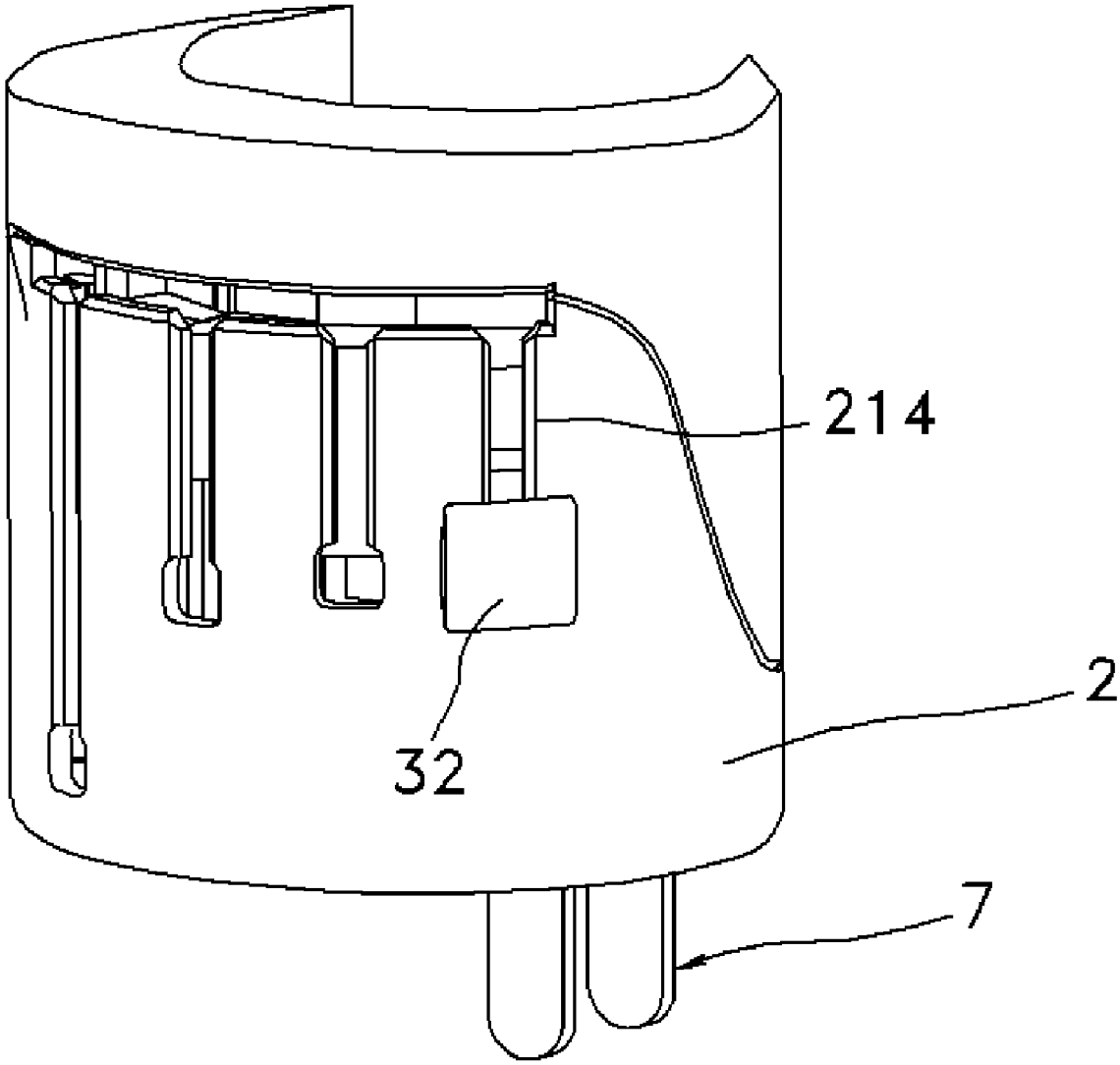
FIG. 14 is a schematic view showing an operating status of the present invention with a plug of USA specification sticking out.

As illustrated in FIG. 11 for an operating status of the European plug 4, the braking pushbutton 32 is pushed down along the slide 211 on the external wall of the base until it reaches the lowest end of the slide to be ejected by the force of the spring 323 contained in the braking pushbutton 32. The ejected pushbutton 32 engages the wall of the slide and is secured in place to complete the process of forcing out the plug in the fashion as described above. On the contrary, the pushbutton 32 is depressed to retract the spring 323 disposed therein to push up the braking pushbutton 32 to the highest end of the slide 211. Accordingly, the braking pushbutton 32 is secured in place by the force of the spring 323. FIG. 12 shows an operating status of the Australian plug 5. Wherein, the European plug is retracted as illustrated in FIG. 11 and the rotary switch 3 is turned to where the Australian plug 5 is located. Again, the braking pushbutton 32 is pushed down in the slide 212 along the external wall of the base 2 to complete the process or ejecting the Australian plug 5 in a similar fashion as described for the European plug 4. The similar fashion of ejecting the plug applies to the UK plug 6 and the USA plug 7 as respectively illustrated in FIGS. 13 and 14.

The prevent invention provides an improved structure of a universal power adapter containing multiple plugs of different specifications, and the application for a utility patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

We claim:

1. A universal power adapter includes a lid and a base; multiple channels, two in most cases, being disposed on the external wall of the base; a standardized plug being inserted to each channel; a rotary switch including a bar sliding block and a braking pushbutton; the bar sliding block containing a bar slide and a gap; the braking pushbutton being inserted into the gap; a protruding block being disposed to the top of each plug and a slot being disposed merely below the protruding block; the slot receiving an insertion end of the braking pushbutton; the insertion end being capable of sliding in the channel on the external wall of the base; the protruding block of each block being inserted into the bar slide of the bar sliding block; and the bar sliding block being capable of passing through the bar slide to slide against the protruding block.

2. A universal power adapter of claim 1, wherein the bar sliding block is made in arc structure.

3. A universal power adapter of claim 1, wherein a space is disposed in the insertion end of the braking pushbutton; a spring is installed in the space; the braking pushbutton slides in the channel to eject the plug; and the braking pushbutton is ejected to engage the slide and secured in place.

4. A universal power adapter of claim 1, wherein each plug is disposed with a metal plate to execute electric contact with a connection conductor, and a pair of blades to be inserted into a power socket.

5. A universal power adapter of claim 1, wherein multiple pairs of adapter outlets are disposed to the lid; a metal contact conducted through the connection conductor is inserted in each outlet; and corresponding through holes are disposed at the bottom of the base to permit blades to stick out of the plug socket.

* * * * *